US010098476B2

(12) United States Patent
Winterhalter et al.

(10) Patent No.: US 10,098,476 B2
(45) Date of Patent: Oct. 16, 2018

(54) CHILD HIGH CHAIR

(71) Applicant: Wonderland Switzerland AG, Steinhausen (CH)

(72) Inventors: Andrew Winterhalter, West Lawn, PA (US); Nathanael Saint, Morgantown, PA (US)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 15/497,196

(22) Filed: Apr. 25, 2017

(65) Prior Publication Data

US 2017/0311733 A1 Nov. 2, 2017

Related U.S. Application Data

(60) Provisional application No. 62/329,594, filed on Apr. 29, 2016, provisional application No. 62/362,306, filed on Jul. 14, 2016, provisional application No. 62/380,734, filed on Aug. 29, 2016.

(51) Int. Cl.

| | |
|---|---|
| ***A47D 1/00*** | (2006.01) |
| ***A47D 1/02*** | (2006.01) |
| ***A47D 11/02*** | (2006.01) |
| *A47D 1/04* | (2006.01) |

(52) U.S. Cl.

CPC ..... *A47D 1/002* (2013.01); *A47D 1/023* (2017.05); *A47D 11/02* (2013.01); *A47D 1/04* (2013.01)

(58) Field of Classification Search

CPC .... A47D 1/008; A47D 1/0081; A47D 1/0083; A47D 1/0085; A47D 1/002; A47D 1/023; A47D 1/04; A47D 11/02

USPC ..... 297/148, 149, 150, 151, 152, 153, 154, 297/155, 354.13

See application file for complete search history.

(56) References Cited

U.S. PATENT DOCUMENTS

| | | | | |
|---|---|---|---|---|
| 4,762,364 A * | 8/1988 | Young | B60N 2/2821 | 297/130 |
| 5,131,719 A * | 7/1992 | Kassai | A47D 1/002 | 297/151 X |
| 5,507,550 A * | 4/1996 | Maloney | A47D 1/002 | 297/149 |

(Continued)

FOREIGN PATENT DOCUMENTS

| | | |
|---|---|---|
| CN | 103653966 A | 3/2014 |
| EP | 2 008 550 A1 | 12/2008 |

*Primary Examiner* — Rodney B White

(74) *Attorney, Agent, or Firm* — Winston Hsu

(57) ABSTRACT

A child high chair includes a high chair frame, a booster seat and a youth seat assembled with each other. A booster seat backrest is rotatably disposed on a booster seat bottom. A booster seat headrest is rotatably disposed on the booster seat backrest and opposite to the booster seat bottom. A booster seat reclining mechanism is located inside the booster seat backrest and actuated to rotate the booster seat headrest while the booster seat backrest is rotated relative to the booster seat bottom. A youth seat footrest is rotatably disposed on a youth seat bottom. A youth seat backrest is rotatably disposed on the youth seat bottom and opposite to the youth seat footrest. A youth seat reclining mechanism is located inside the youth seat bottom to rotate the youth seat footrest via rotation of the youth seat backrest simultaneously driven by reclining of the booster seat backrest.

19 Claims, 14 Drawing Sheets

(56) References Cited

U.S. PATENT DOCUMENTS

| | | | | |
|---|---|---|---|---|
| 5,524,964 | A * | 6/1996 | Weimersheimer | B60N 2/14 297/354.13 X |
| 5,681,084 | A * | 10/1997 | Yoneda | A47D 1/002 297/354.13 X |
| 6,196,629 | B1 * | 3/2001 | Onishi | B60N 2/2806 297/354.13 X |
| 6,679,552 | B1 * | 1/2004 | Kassai | B60N 2/2812 297/250.1 |
| 7,568,758 | B2 * | 8/2009 | Troutman | A47D 1/002 297/148 |
| 7,722,118 | B2 * | 5/2010 | Bapst | A47D 9/02 297/256.12 |
| 7,753,445 | B2 * | 7/2010 | Kassai | B60N 2/2824 297/253 |
| 7,918,497 | B2 * | 4/2011 | Keegan | A47D 1/008 297/118 |
| 2001/0048237 | A1 * | 12/2001 | Kassai | B60N 2/146 297/256.12 |
| 2003/0011221 | A1 * | 1/2003 | Yoshie | A47D 1/002 297/354.13 X |
| 2003/0218366 | A1 * | 11/2003 | Rho | A47D 1/002 297/153 |
| 2004/0026976 | A1 * | 2/2004 | Chen | A47D 1/002 297/151 X |

* cited by examiner

CHILD HIGH CHAIR

CROSS REFERENCE TO RELATED APPLICATIONS

This application claims the benefit of U.S. provisional application No. 62/329,594 (which was filed on Apr. 29, 2016), U.S. provisional application No. 62/362,306 (which was filed on Jul. 14, 2016), and U.S. provisional application No. 62/380,734 (which was filed on Aug. 29, 2016). The entire contents of these related applications are incorporated herein by reference.

BACKGROUND OF THE INVENTION

1. Field of the Invention

The present invention relates to a child high chair, and more particularly, to a child high chair capable of being switched between different application modes.

2. Description of the Prior Art

A conventional child high chair is suitable for children younger than six-year-old, and a seat height of the child high chair can be adjusted to be close to the caregiver for conveniently attending to the child. However, the current conventional child high chair lacks to accommodate children from birth to six months because the current conventional high chair does not always recline far enough for a newborn child and most parents don't think to use the child high chair early. Even if the seat of another conventional child high chair can be reclined enough, the said conventional child high chair having the newborn child is not close to the caregiver and is inconvenient though the caregiver may not feed the newborn child in the child high chair, and further, the seat of the conventional child high chair does not seem to comfort for the newborn child. Therefore, design of a child high chair capable of accommodating children of various age ranges is an important issue in the related mechanical design industry.

SUMMARY OF THE INVENTION

The present invention provides a child high chair capable of being switched between different application modes for solving above drawbacks.

According to the claimed invention, a child high chair includes a high chair frame, a booster seat and a youth seat. The booster seat and the youth seat are disposed on the high chair frame. The youth seat includes a youth seat bottom, a youth seat footrest, a youth seat backrest and a youth seat reclining mechanism. The youth seat footrest is rotatably disposed on the youth seat bottom. The youth seat backrest is rotatably disposed on the youth seat bottom and opposite to the youth seat footrest. The youth seat reclining mechanism is located inside the youth seat bottom and connected between the youth seat footrest and the youth seat backrest. The booster seat is movably disposed on the youth seat bottom, and the youth seat footrest is rotated relative to the youth seat bottom via the youth seat reclining mechanism while the youth seat backrest is simultaneously rotated by reclining of the booster seat.

According to the claimed invention, the booster seat includes a booster seat bottom, a booster seat backrest, a booster seat headrest and a booster seat reclining mechanism. The booster seat backrest is rotatably disposed on the booster seat bottom. The booster seat headrest is rotatably disposed on the booster seat backrest and opposite to the booster seat bottom. The booster seat reclining mechanism is located inside the booster seat backrest and connected between the booster seat bottom and the booster seat headrest. The booster seat reclining mechanism is actuated to rotate the booster seat headrest relative to the booster seat backrest while the booster seat backrest is rotated relative to the booster seat bottom.

According to the claimed invention, the booster seat backrest includes a rib contacting against the youth seat backrest, and the youth seat backrest is rotated by pressure of the rib while the booster seat backrest is rotated relative to the booster seat bottom.

According to the claimed invention, a plurality of reclined opening structures is formed on the booster seat bottom, and the booster seat backrest includes a reclined plunger detachably engaged with one of the plurality of reclined opening structures to steady an included angle of the booster seat backrest relative to the booster seat bottom. A reclined actuating component is movably disposed on the booster seat headrest, two ends of a connective cable are respectively connected to the reclined actuating component and the reclined plunger, and the reclined plunger is pulled to disengage from the plurality of reclined opening structures via movements of the reclined actuating component and the connective cable.

According to the claimed invention, the booster seat reclining mechanism includes a curved linking component passing through the booster seat backrest, a first link end of the curved linking component is pivotally connected to the booster seat headrest and a second link end of the curved linking component opposite to the first link end is pivotally connected to the booster seat bottom. A pivot between the first link end and the booster seat headrest is distant from a pivot between the booster seat headrest and the booster seat backrest, and a pivot between the second link end and the booster seat bottom is distant from a pivot between the booster seat backrest and the booster seat bottom.

According to the claimed invention, the booster seat reclining mechanism further includes a headrest slot structure disposed on the booster seat headrest, and the first link end of the curved linking component is slidably and rotatably located inside the headrest slot structure. The booster seat headrest is not rotated relative to the booster seat backrest while the first link end is slid inside the headrest slot structure, and the curved linking component is actuated to rotate the booster seat headrest relative to the booster seat backrest while the first link end contacts against an end of the headrest slot structure.

According to the claimed invention, the youth seat reclining mechanism includes a backrest linking component, a bottom rocker and a footrest linking component. The backrest linking component is rigidly connected to the youth seat backrest, the footrest linking component is rotatably connected to the youth seat footrest, the bottom rocker is pivotally connected inside the youth seat bottom, and two arms of the bottom rocker are respectively connected to the backrest linking component and the footrest linking component. The backrest linking component is rigidly connected to the youth seat backrest via a square tube, and synchronously rotated in accordance with rotation of the youth seat backrest relative to the youth seat bottom.

According to the claimed invention, the two opposite arms of the bottom rocker includes a first rocker arm and a second rocker arm, the first rocker arm is slidably located inside a backrest slot structure formed on the backrest linking component, and the footrest linking component is slidably located inside a rocker slot structure formed on the second rocker arm. The youth seat footrest is rotated by pulling of the footrest linking component while the first rocker arm contacts against an end of the backrest slot structure and the footrest linking component contacts against an end of the rocker slot structure.

According to the claimed invention, the booster seat reclining mechanism includes a backrest rocker, a headrest linking component, a bottom linking component, a backrest cam and a seat follower. The backrest rocker is pivotally connected inside the booster seat bottom, two opposite ends of the headrest linking component are respectively connected to a first rocker arm of the backrest rocker and the booster seat headrest, two opposite ends of the bottom linking component are respectively connected to a second rocker arm of the backrest rocker and the seat follower, the backrest cam is fixed to the booster seat backrest, the seat follower is movably disposed on the booster seat bottom and slidably contacts against the backrest cam. The backrest cam moves the seat follower into a retracted position while the booster seat backrest is reclined, and the seat follower pulls rotation of the backrest rocker via the bottom linking component to rotate the booster seat headrest.

According to the claimed invention, the booster seat reclining mechanism further includes a resilient component disposed between the seat follower and the booster seat bottom. The backrest cam is separated from the seat follower and the seat follower is recovered to an extended position via the resilient component while the booster seat backrest is upright, and the backrest rocker is rotated by movements of the seat follower and the bottom linking component, to recline the booster seat headrest via the headrest linking component. A pivot between the headrest linking component and the booster seat headrest is distant from a pivot between the booster seat headrest and the booster seat backrest. The booster seat reclining mechanism further includes a roller disposed on a front end of the seat follower to contact against the backrest cam. The bottom linking component is a bar or a cable.

According to the claimed invention, the booster seat reclining mechanism includes a backrest rocker, a headrest linking component and a seat linking component. The backrest rocker is pivotally connected inside the booster seat backrest, two opposite ends of the headrest linking component are respectively connected to a first rocker arm of the backrest rocker and the booster seat headrest, and two opposite ends of the seat linking component are respectively connected to a second rocker arm of the backrest rocker and the booster seat bottom. While the booster seat backrest is reclined or upright, the backrest rocker is rotated to drive the headrest linking component to push or pull the booster seat headrest accordingly, so as to rotate the booster seat headrest accordingly.

According to the claimed invention, a link slot structure is disposed on the headrest linking component, and a part of the booster seat headrest is slidably located inside the link slot structure. A pivot between the headrest linking component and the booster seat headrest is distant from a pivot between the booster seat headrest and the booster seat backrest. The booster seat headrest is rotated inwardly relative to the booster seat backrest and the youth seat footrest is rotated upwardly relative to the youth seat bottom in accordance with reclining of the booster seat upon the youth seat.

The child high chair without the booster seat can be used in the kid mode, and the child high chair with the booster seat can be used in the toddler mode or the infant mode (which depends on a reclined angle of the booster seat backrest relative to the booster seat bottom). As the booster seat backrest of the booster seat is reclined, the youth seat reclining mechanism is applied to upward rotate the youth seat footrest and the booster seat reclining mechanism is applied to inward rotate the booster seat headrest, and the upward rotation of the youth seat footrest and the inward rotation of the booster seat headrest may be optionally delayed in accordance with the reclined angle's variation of the booster seat backrest, so that the child high chair of the present invention can comfortably fit children of various age ranges.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
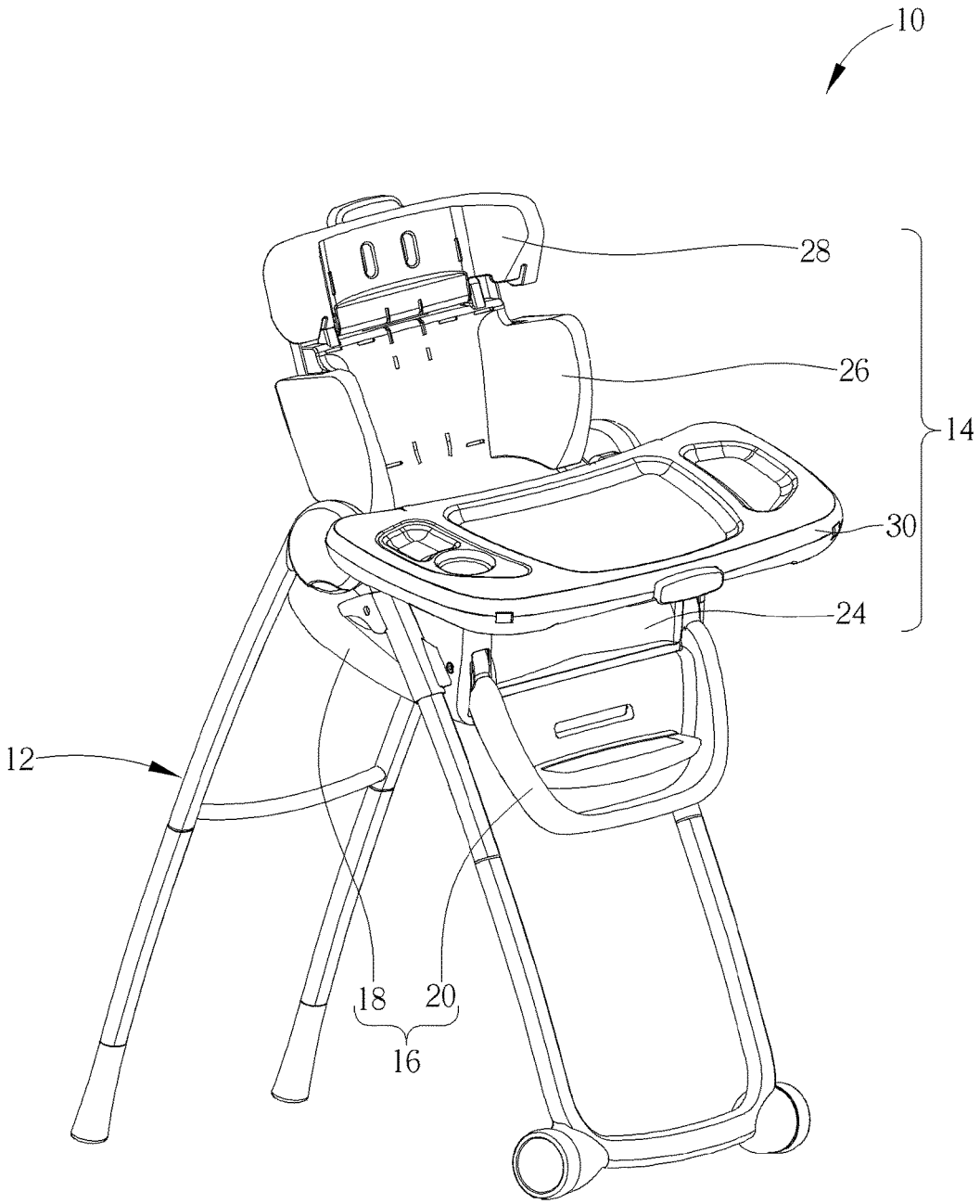
FIG. 1 to FIG. 3 respectively are diagrams of a child high chair in different applications according to an embodiment of the present invention.
Figure 2:
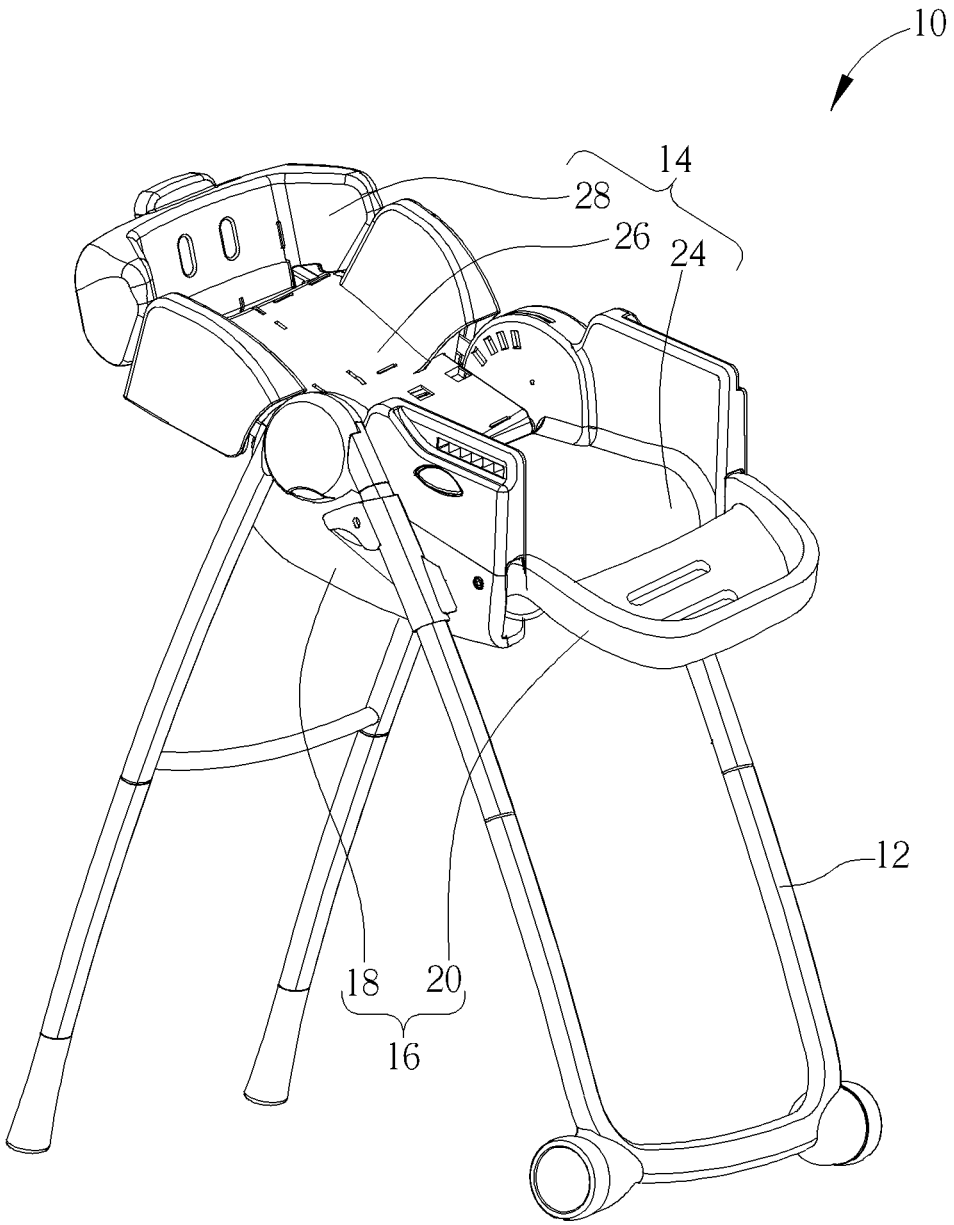
Figure 3:
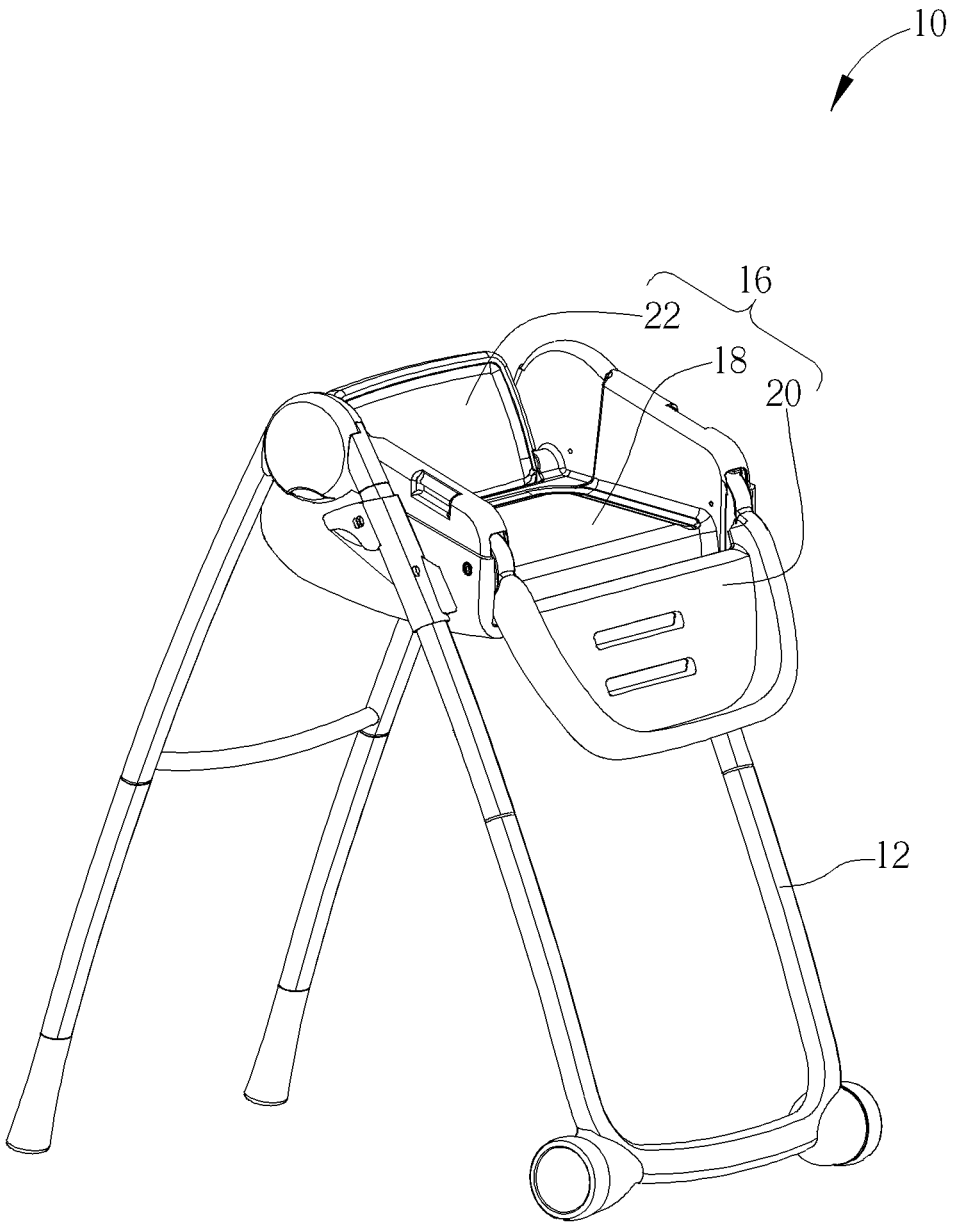

Please refer to FIG. 1 to FIG. 3. FIG. 1 to FIG. 3 respectively are diagrams of a child high chair 10 in different applications according to an embodiment of the present invention. The child high chair 10 includes a high chair frame 12, a booster seat 14 and a youth seat 16. The youth seat 16 is disposed on the high chair frame 12, and the booster seat 14 can be movably assembled with the youth seat 16 to locate above the high chair frame 12, such as the child high chair 10 shown in FIG. 1 and FIG. 2. The booster seat 14 is able to be detached from and rotated relative to the youth seat 16. Further, the youth seat 16 can be disposed on the high chair frame 12 without the booster seat 14, which is shown in FIG. 3. The youth seat 16 includes a youth seat bottom 18, a youth seat footrest 20 and a youth seat backrest 22. The youth seat footrest 20 and the youth seat backrest 22 are rotatably disposed on opposite sides of the youth seat footrest 20, respectively. While the booster seat 14 is disassembled from the youth seat 16, the child high chair 10 is switched into a kid mode (which can be shown in FIG. 3), and the youth seat footrest 20 and the youth seat backrest 22 can be rotated according to the body type of youth child for comfortable experience.

The booster seat 14 includes a booster seat bottom 24, a booster seat backrest 26, a booster seat headrest 28 and a booster seat tray 30. The booster seat bottom 24 and the booster seat headrest 28 are rotatably disposed on opposite sides of the booster seat backrest 26, respectively. The booster seat tray 30 is assembled with the booster seat bottom 24 in a detachable manner. The booster seat 14 can be assembled with an adult size kitchen chair (not shown in figures). While the booster seat 14 is assembled with the youth seat 16, the booster seat backrest 26 can be upright to switch the child high chair 10 into a toddler mode (which can be shown in FIG. 1), or the booster seat backrest 26 can be reclined to switch the child high chair 10 into an infant mode (which can be shown in FIG. 2). As the child high chair 10 is switched from the toddler mode to the infant mode, the booster seat backrest 26 is pressed and reclined by a user, the booster seat headrest 28 can be rotated automatically and inwardly relative to the booster seat backrest 26, and the youth seat footrest 20 can be rotated automatically and upwardly to provide a cozy and safe environment for a newborn infant.

Figure 4:
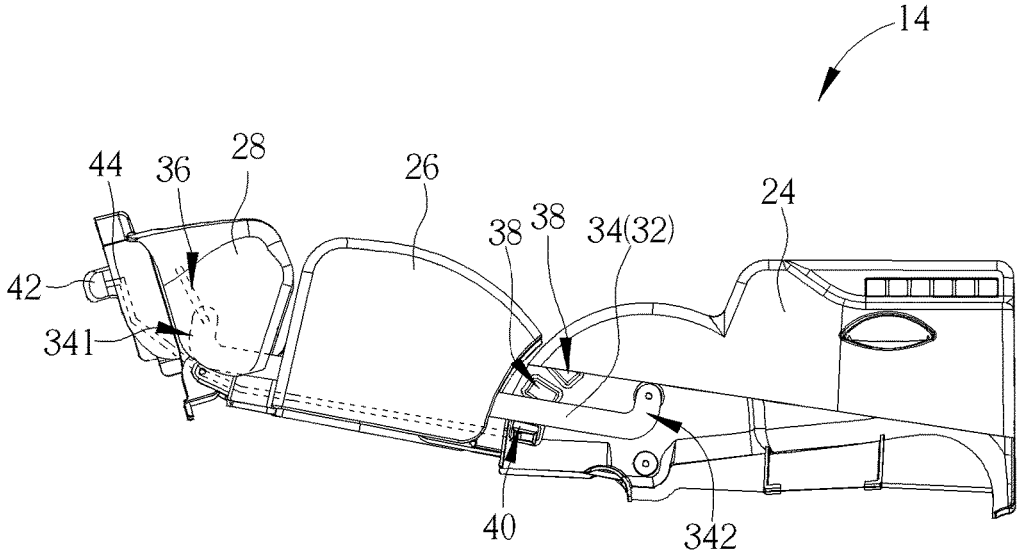
FIG. 4 is an appearance diagram of the booster seat reclining mechanism and the related booster seat according to a first embodiment of the present invention.
Figure 5:
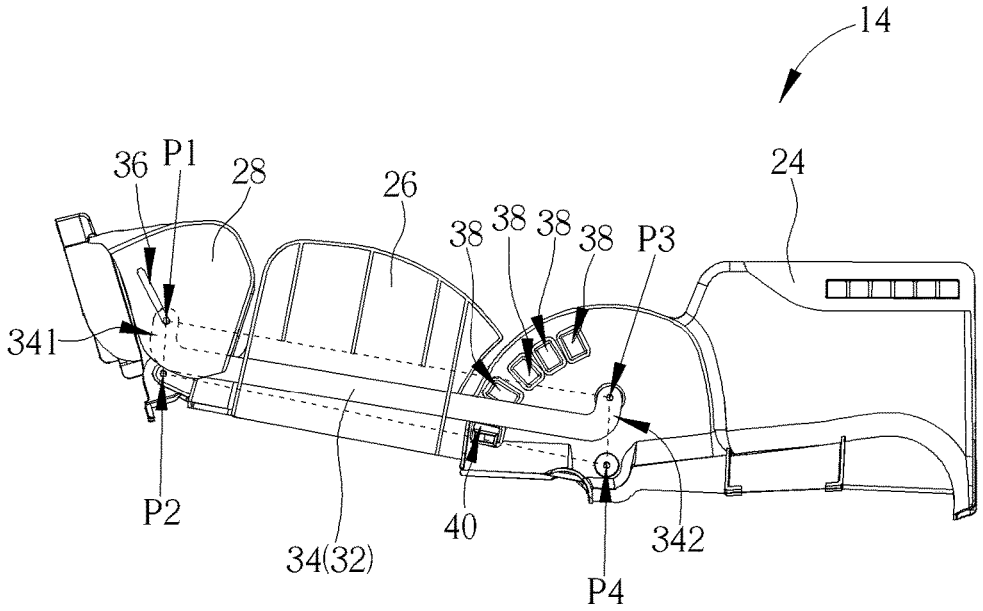
FIG. 5 to FIG. 7 respectively are diagrams of the booster seat reclining mechanism and the related booster seat in different operation steps according to the first embodiment of the present invention.
Figure 6:
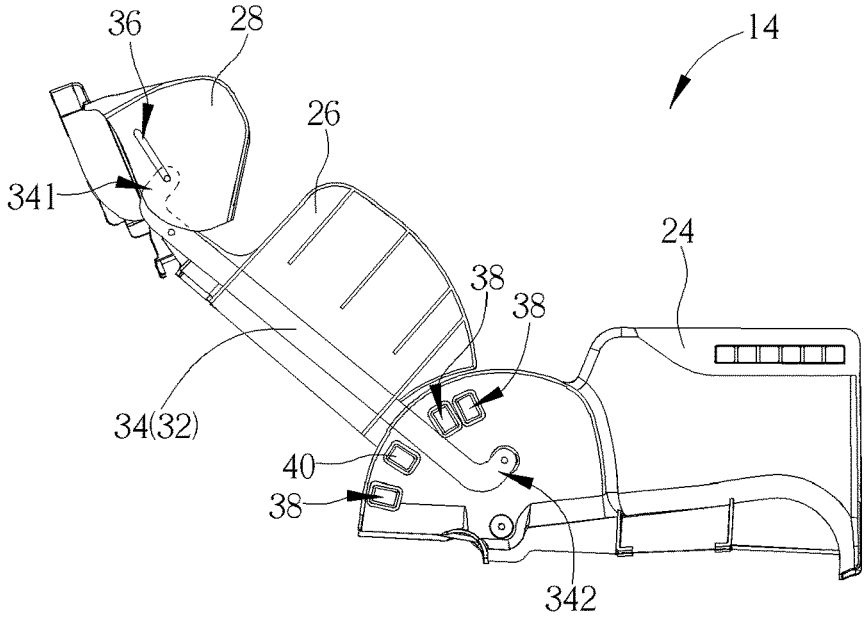
Figure 7:
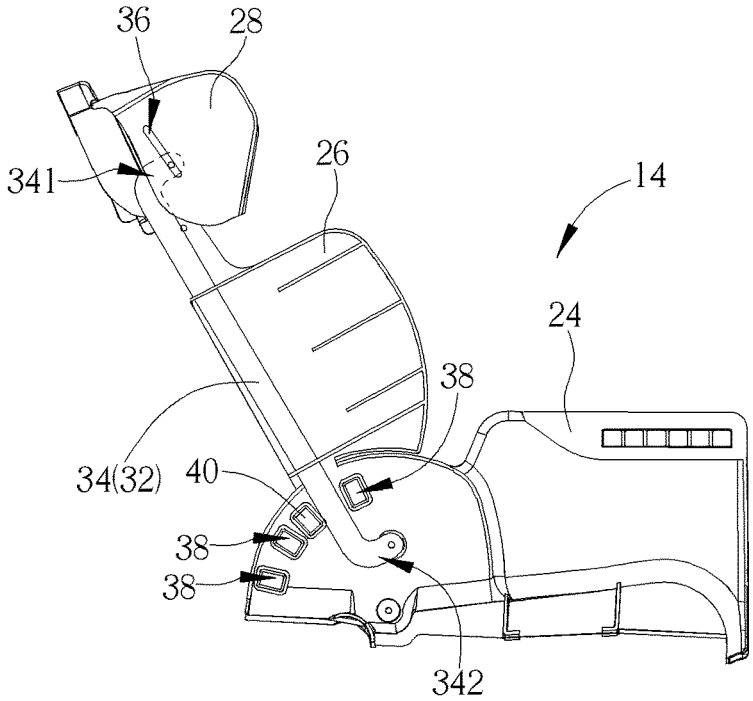

The booster seat 14 further includes a booster seat reclining mechanism 32 located inside the booster seat backrest 26. Please refer to FIG. 4 to FIG. 7. FIG. 4 is an appearance diagram of the booster seat reclining mechanism 32 (and the related booster seat 14) according to a first embodiment of the present invention. FIG. 5 to FIG. 7 respectively are diagrams of the booster seat reclining mechanism 32 (and the related booster seat 14) in different operation steps according to the first embodiment of the present invention. The booster seat reclining mechanism 32 includes a curved linking component 34 passing through the booster seat backrest 26. The curved linking component 34 has a first link end 341 and a second link end 342 opposite to each other. The first link end 341 is pivotally connected to the booster seat headrest 28 and the second link end 342 is pivotally connected to the booster seat bottom 24.

In the first embodiment, a pivot P1 between the first link end 341 and the booster seat headrest 28 is distant from a pivot P2 between the booster seat headrest 28 and the booster seat backrest 26, a pivot P3 between the second link end 342 and the booster seat bottom 24 is distant from a pivot P4 between the booster seat backrest 26 and the booster seat bottom 24, and the first link end 341 is preferably slidably and rotatably located inside a headrest slot structure 36 disposed on the booster seat headrest 28, so as to form a four bar linkage with one sliding point (which is represented as the pivot P1 about the first link end 341).

While the booster seat backrest 26 is upright from the position shown in FIG. 5 to the position shown in FIG. 7, the curved linking component 34 is rotated in accordance with a movement of the booster seat backrest 26, the first link end 341 is moved from a lower end to an upper end of the headrest slot structure 36, and the booster seat headrest 28 can be rotated in a counterclockwise direction by pressure of the curved linking component 34 until the first link end 341 hits the upper end. While the booster seat backrest 26 is reclined from the position shown in FIG. 7 to the position shown in FIG. 5, the first link end 341 is freely slid inside the headrest slot structure 36 and the booster seat headrest 28 is not rotated relative to the booster seat backrest 26, and then the curved linking component 34 can be actuated to rotate the booster seat headrest 28 inwardly relative to the booster seat backrest 26 until the first link end 341 contacts against the lower end of the headrest slot structure 36. That is to say, the headrest slot structure 36 is used to allow the booster seat headrest 28 to delay rotation till the booster seat backrest 26 is partially reclined.

In addition, as shown in FIG. 4 to FIG. 7, a plurality of reclined opening structures 38 is formed on the booster seat bottom 24, and the booster seat backrest 26 has a reclined plunger 40 accordingly. As the booster seat backrest 26 is reclined or upright relative to the booster seat bottom 24, the reclined plunger 40 can be detachably engaged with one of the plurality of reclined opening structures 38, to steady an included angle between the booster seat backrest 26 and the booster seat bottom 24. A reclined actuating component 42 is movably disposed on the booster seat headrest 28, and two ends of a connective cable 44 are respectively connected to the reclined actuating component 42 and the reclined plunger 40. The connective cable 44 can be a flexible cable or a metal cable. The reclined actuating component 42 is moved in a linear motion by pressure of the user, the connective cable 44 which is pulled by the reclined actuating component 42 is applied to pull the reclined plunger 40, and the reclined plunger 40 is disengaged from the corresponding reclined opening structure 38 to allow rotation of the booster seat backrest 26 relative to the booster seat bottom 24.

Figure 8:
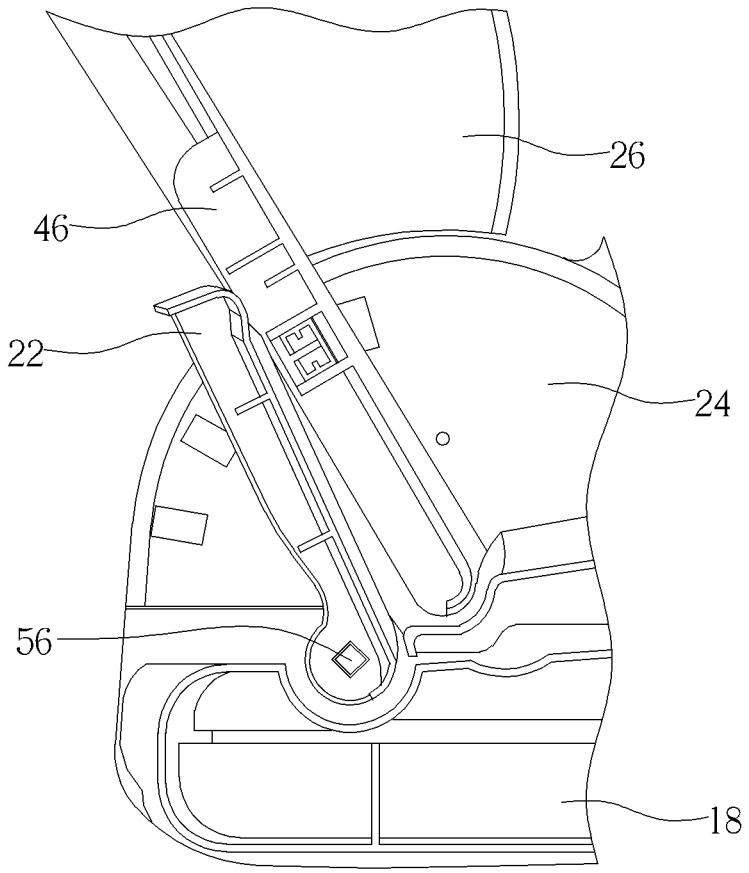
FIG. 8 is a diagram of a partial assembly about the booster seat and the youth seat according to the embodiment of the present invention.
Figure 9:
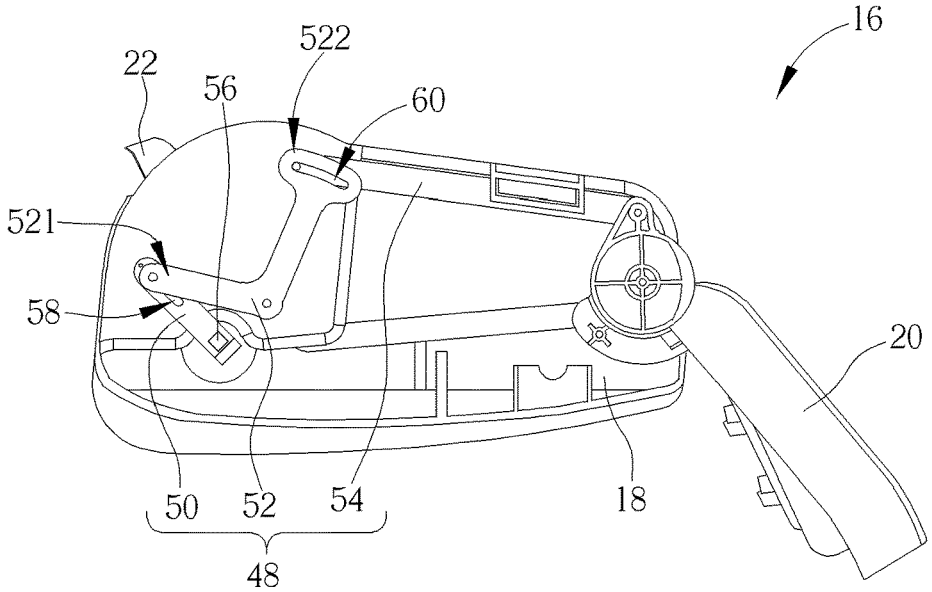
FIG. 9 to FIG. 11 respectively are diagrams of the youth seat in different operation steps according to the embodiment of the present invention.
Figure 10:
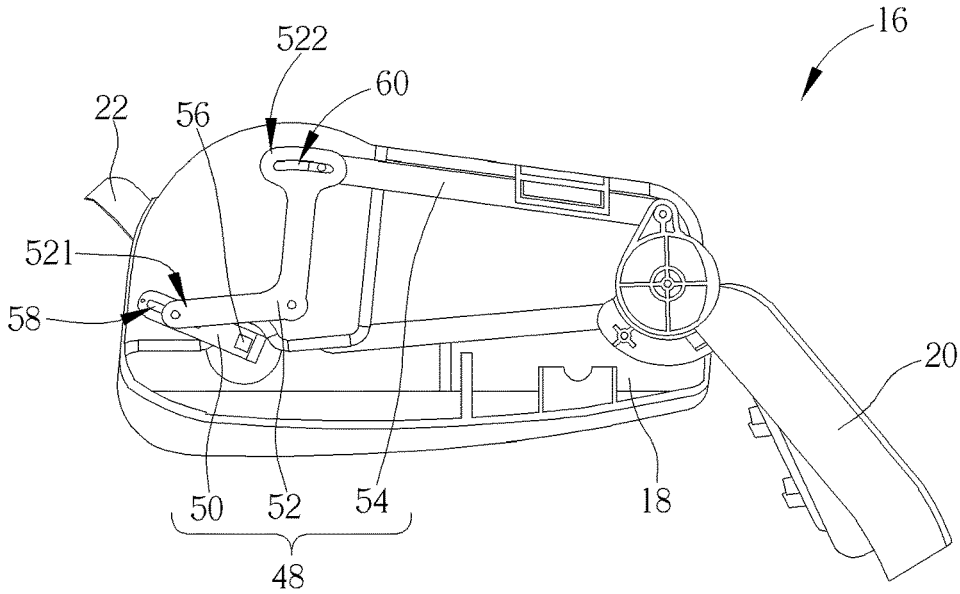
Figure 11:
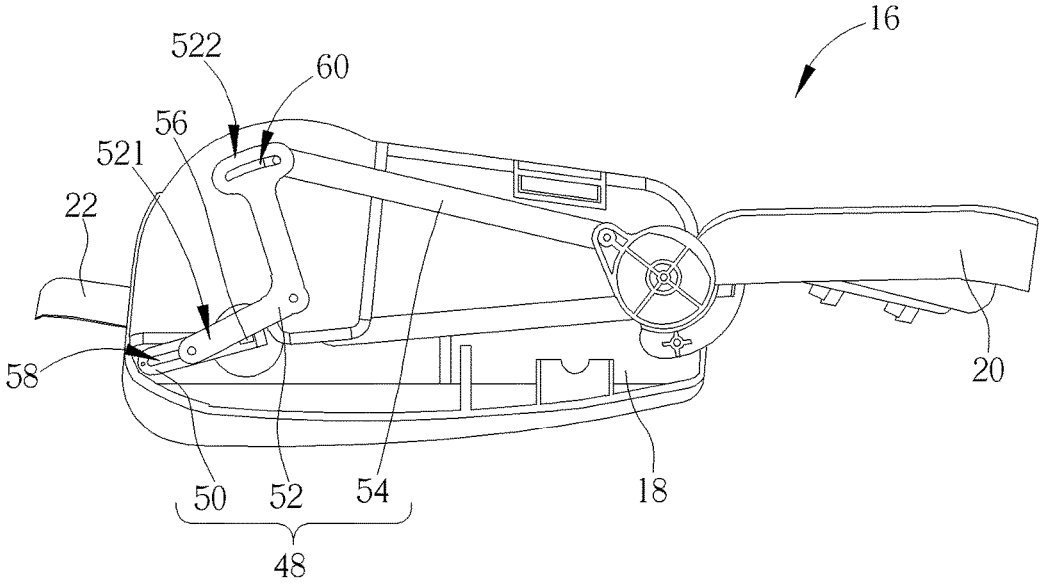

Please refer to FIG. 8 to FIG. 11. FIG. 8 is a diagram of a partial assembly about the booster seat 14 and the youth seat 16 according to the embodiment of the present invention. FIG. 9 to FIG. 11 respectively are diagrams of the youth seat 16 in different operation steps according to the embodiment of the present invention. As shown in FIG. 8, the booster seat backrest 26 may have a rib 46 disposed on the back of the booster seat backrest 26. The booster seat 14 is assembled with the youth seat 16 to contact the rib 46 against the youth seat backrest 22, and the youth seat backrest 22 can be rotated by pressure of the rib 46 while the booster seat backrest 26 is reclined relative to the booster seat bottom 24. A torsion spring (not shown in figures) may be disposed on an axis between the youth seat backrest 22 and the youth seat bottom 18, so that the youth seat backrest 22 can be recovered to an upright position while the booster seat backrest 26 is upward rotated; besides, a lock-out mechanism (not shown in figures) may be used to lock the youth seat backrest 22 in a current position while the booster seat backrest 26 is upward rotated or the booster seat 14 is disassembled from the youth seat 16.

The youth seat 16 further includes a youth seat reclining mechanism 48 located inside the youth seat bottom 18. As shown in FIG. 9 to FIG. 11, the youth seat reclining mechanism 48 includes a backrest linking component 50, a bottom rocker 52 and a footrest linking component 54. The backrest linking component 50 is rigidly connected to the youth seat backrest 22 via a square tube 56, which means the backrest linking component 50 can be synchronously rotated in accordance with rotation of the youth seat backrest 22 relative to the youth seat bottom 18. The footrest linking component 54 is rotatably connected to a protrusion of the youth seat footrest 20, and two arms of the bottom rocker 52 are respectively connected to the backrest linking component 50 and the footrest linking component 54. The said two arms can be defined as a first rocker arm 521 and a second rocker arm 522. The first rocker arm 521 is slidably located inside a backrest slot structure 58 formed on the backrest linking component 50, a rocker slot structure 60 is formed on the second rocker arm 522 and the footrest linking component 54 is slidably located inside the rocker slot structure 60.

While the youth seat backrest 22 is reclined from a position shown in FIG. 9 to a position shown in FIG. 10, the backrest linking component 50 is rotated in a counterclockwise direction with reclining of the youth seat backrest 22, the first rocker arm 521 slides inside the backrest slot structure 58 to slightly rotate the bottom rocker 52, a point of the footrest linking component 54 is slid inside the second rocker arm 522, and the footrest linking component 54 and the youth seat footrest 20 are motionless. While the youth seat backrest 22 is reclined from a position shown in FIG. 10 to a position shown in FIG. 11, the foresaid point of the footrest linking component 54 contacts against an end of the second rocker arm 522, the footrest linking component 54 is pulled by the bottom rocker 52 and the youth seat footrest 20 begins to upward rotate accordingly. As the youth seat backrest 22 is upright from the position shown in FIG. 11 to the position shown in FIG. 9, clockwise rotation of the backrest linking component 50 results in clockwise rotation of the bottom rocker 52, and the youth seat footrest 20 can be downward rotated by the attraction of gravity.

Therefore, when the child high chair 10 is switched from the toddler mode to the infant mode, the user presses the booster seat backrest 26 to recline relative to the booster seat bottom 24, the booster seat reclining mechanism 32 is actuated to inwardly rotate the booster seat headrest 28 via an optional delay deployment; because of contact between the youth seat backrest 22 and the rib 46 on the booster seat backrest 26, the youth seat backrest 22 is reclined synchronously with reclining of the booster seat backrest 26, the youth seat reclining mechanism. 48 is actuated to upwardly rotate the youth seat footrest 20 via another optional delay deployment. The youth seat footrest 20 is stayed down until the child high chair 10 is entirely switched into the infant mode, so that a toddled kid does not use the child high chair 10 in a partially toddler mode, for preferred safety.

Figure 12:
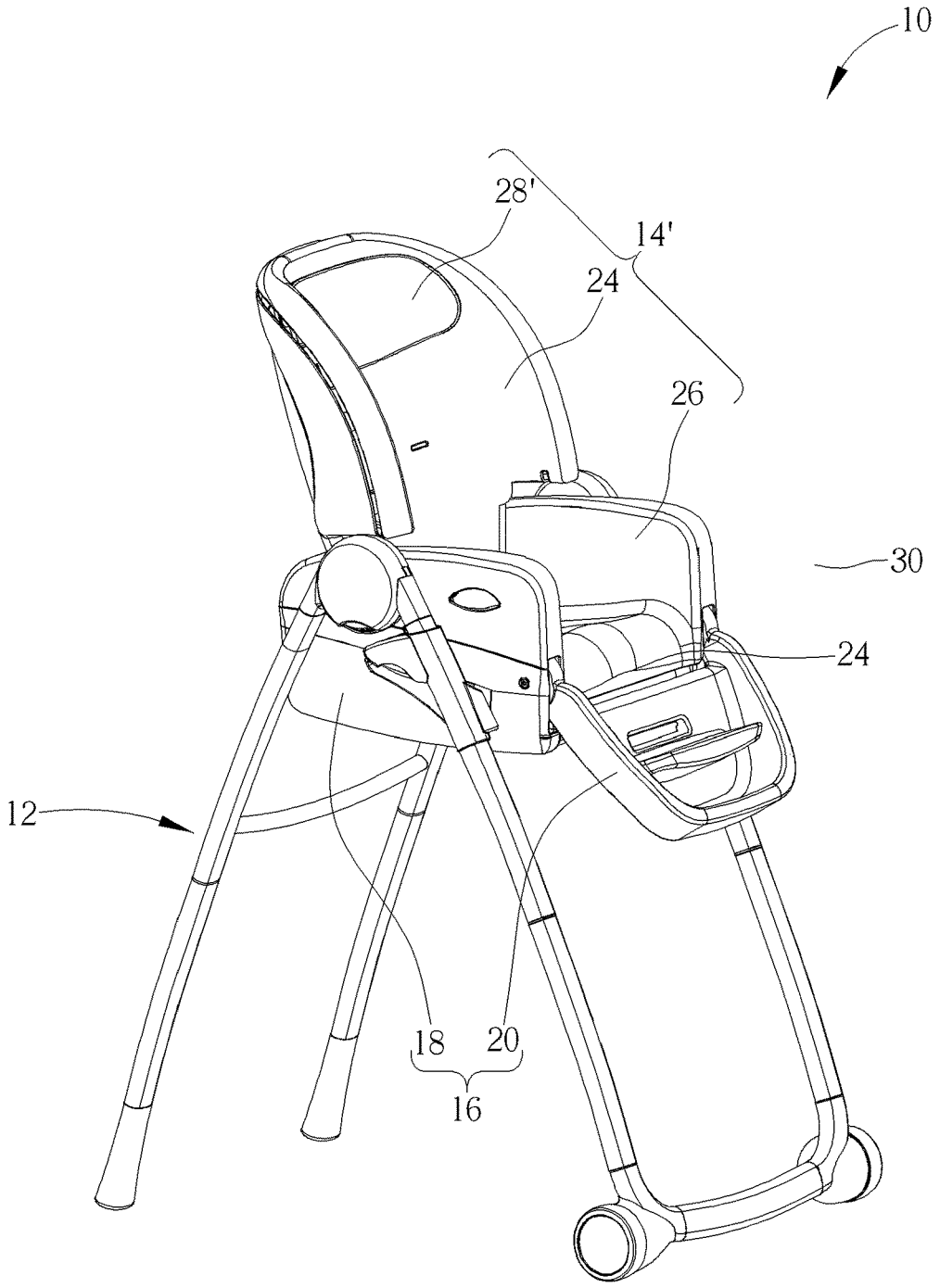
FIG. 12 is a diagram of a booster seat according to another embodiment of the present invention.
Figure 13:
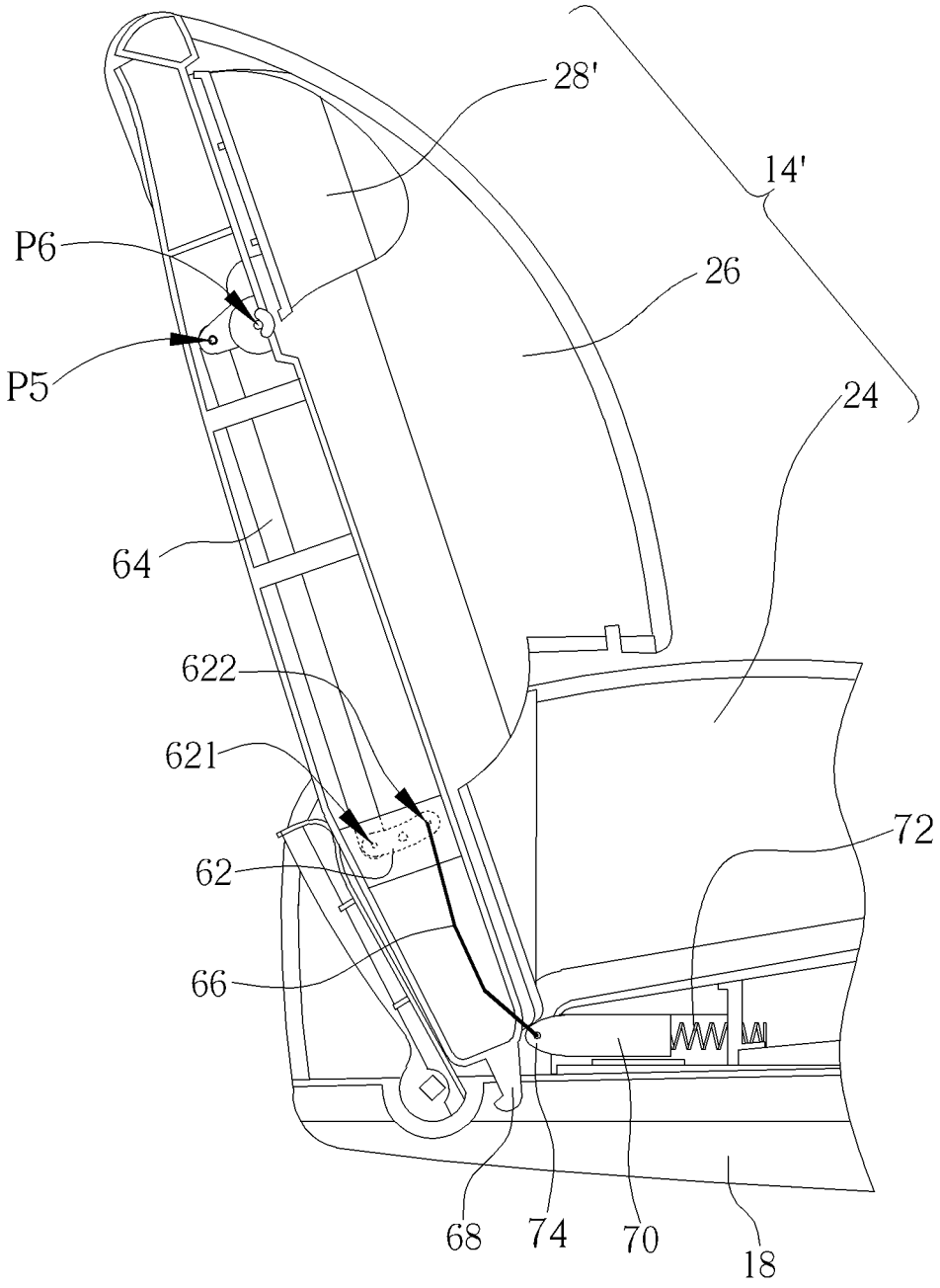
FIG. 13 and FIG. 14 respectively are diagrams of a booster seat reclining mechanism and the related booster seat in different operation steps according to a second embodiment of the present invention.
Figure 14:
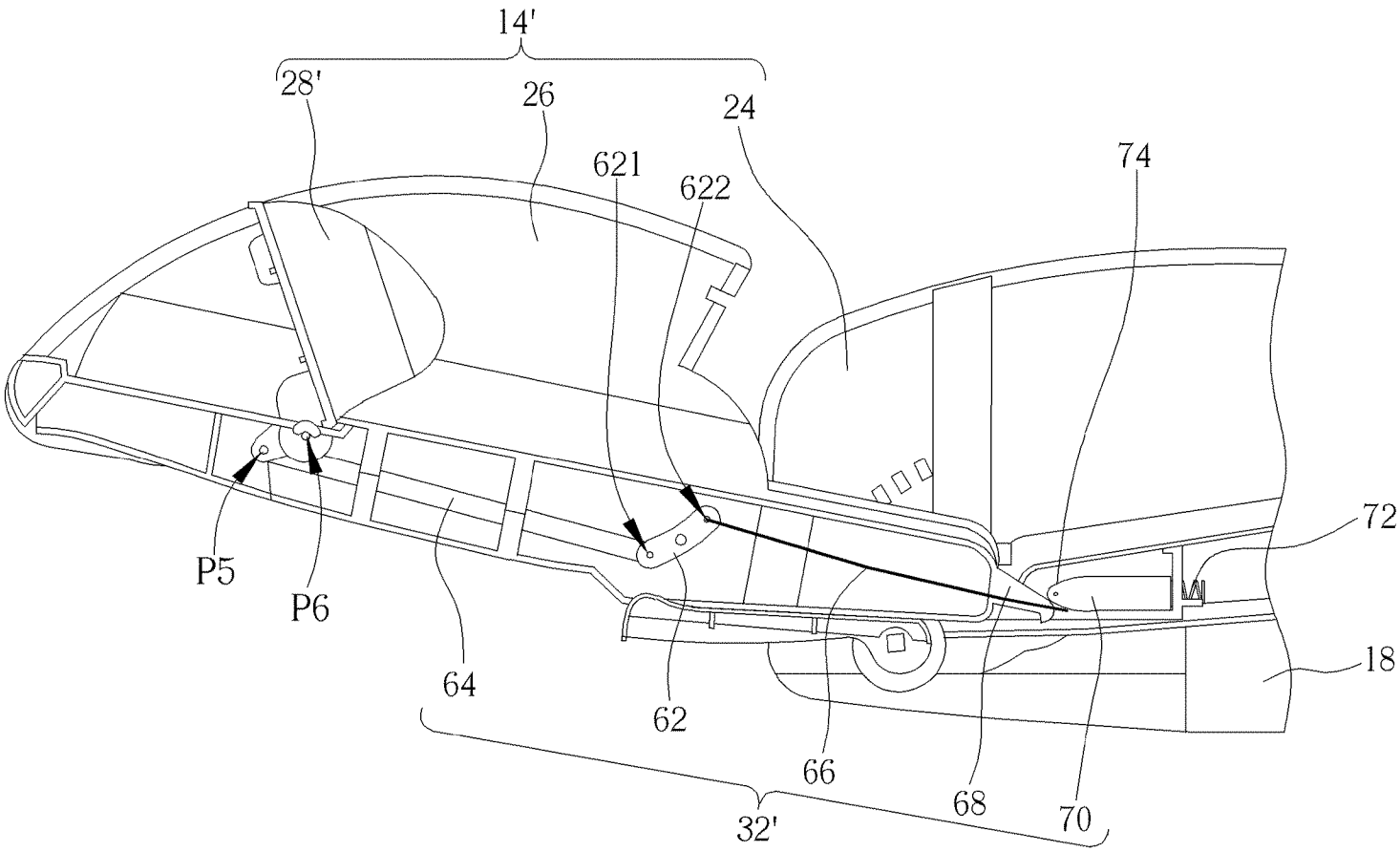

Please refer to FIG. 12 to FIG. 14. FIG. 12 is a diagram of a booster seat 14' according to another embodiment of the present invention. FIG. 13 and FIG. 14 respectively are diagrams of a booster seat reclining mechanism 32' (and the related booster seat 14') in different operation steps according to a second embodiment of the present invention. The booster seat 14' has a booster seat headrest 28' rotatably connected to the booster seat bottom 24 and located inside an accommodating region of the booster seat bottom 24. Relation between the booster seat bottom and the booster seat headrest is not limited to the above-mentioned embodiments shown in FIG. 2 and FIG. 12, which depends on design demand.

In the said second embodiment, the booster seat reclining mechanism 32' includes a backrest rocker 62, a headrest linking component 64, a bottom linking component 66, a backrest cam 68 and a seat follower 70. The backrest rocker 62 is pivotally connected inside the booster seat bottom 24. Two opposite ends of the headrest linking component 64 are respectively connected to a first rocker arm 621 of the backrest rocker 62 and the booster seat headrest 28', and a pivot P5 between the headrest linking component 64 and the booster seat headrest 28' is distant from a pivot P6 between the booster seat headrest 28' and the booster seat backrest 26. Two opposite ends of the bottom linking component 66 are respectively connected to a second rocker arm 622 of the backrest rocker 62 and the seat follower 70 for forming a linkage module. The bottom linking component 66 can be a bar or a cable. The backrest cam 68 is fixed to the booster seat backrest 26, and the seat follower 70 is movably disposed on the booster seat bottom 24 and slidably contacts against the backrest cam 68.

While the booster seat backrest 26 is reclined from a position shown in FIG. 13 to a position shown in FIG. 14, the backrest cam 68 pushes the seat follower 70 into a retracted position, a movement of the seat follower 70 pulls rotation of the backrest rocker 62 (in a clockwise direction) via the bottom linking component 66, the backrest rocker 62 is rotated to shift the headrest linking component 64 and then the booster seat headrest 28' can be inward rotated accordingly. While the booster seat backrest 26 is upright in an opposite direction, the backrest cam 68 is separated from the seat follower 70, a resilient component 72 disposed between the seat follower 70 and the booster seat bottom 24 can provide a resilient recovering force to recover the seat follower 70 to an extended position, so that the backrest rocker 62 can be rotated in a counterclockwise direction and the booster seat headrest 28' can be reclined (such as outward rotated) by guiding of the headrest linking component 64. Besides, the booster seat reclining mechanism 32' may optionally include a roller 74 disposed on a front end of the seat follower 70. The roller 74 contacts against the backrest cam 68 and is utilized to increase smooth slide between the backrest cam 68 and the seat follower 70.

Figure 15:
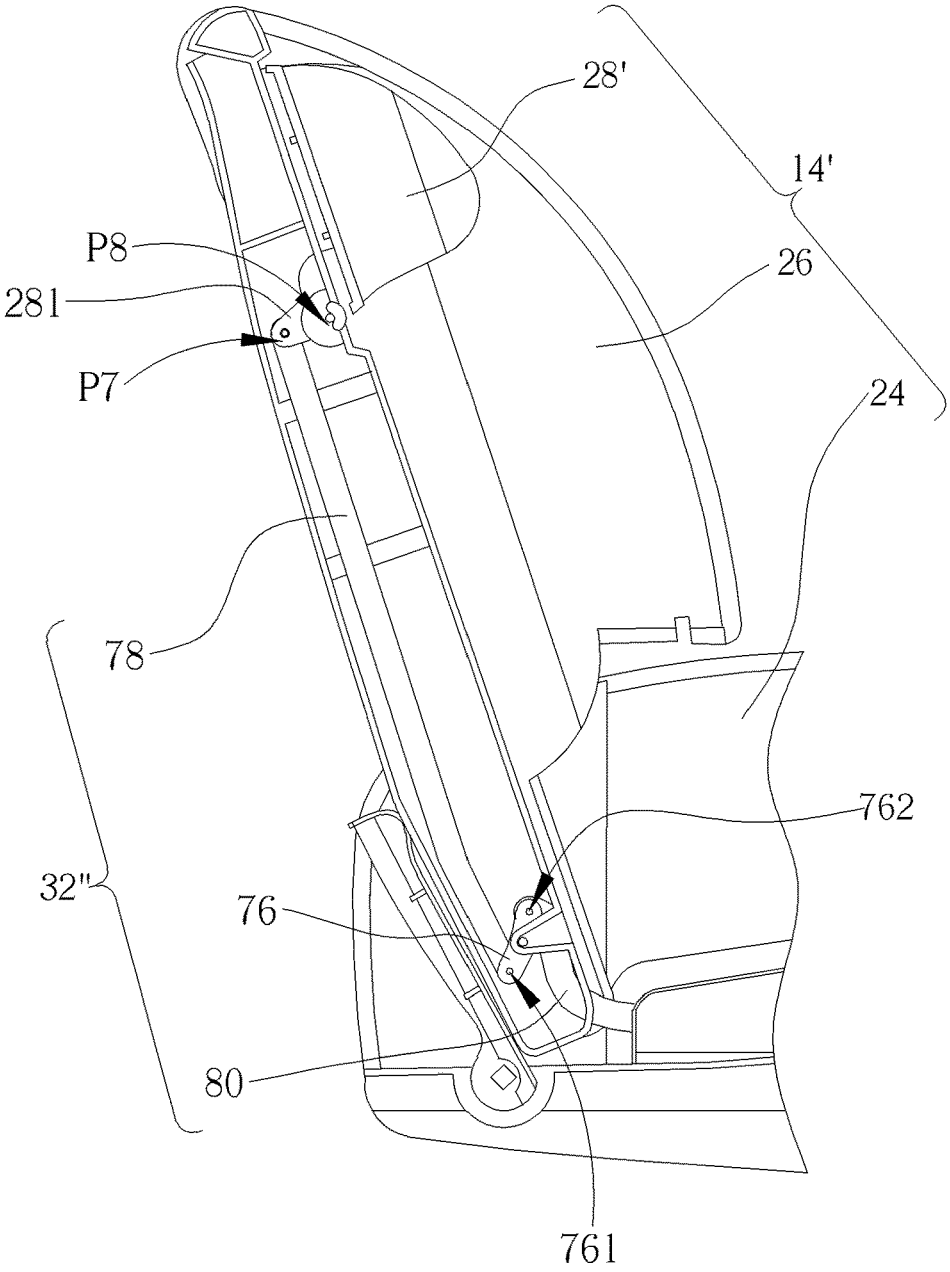
FIG. 15 and FIG. 16 respectively are diagrams of a booster seat reclining mechanism and the related booster seat in different operation steps according to a third embodiment of the present invention.
Figure 16:
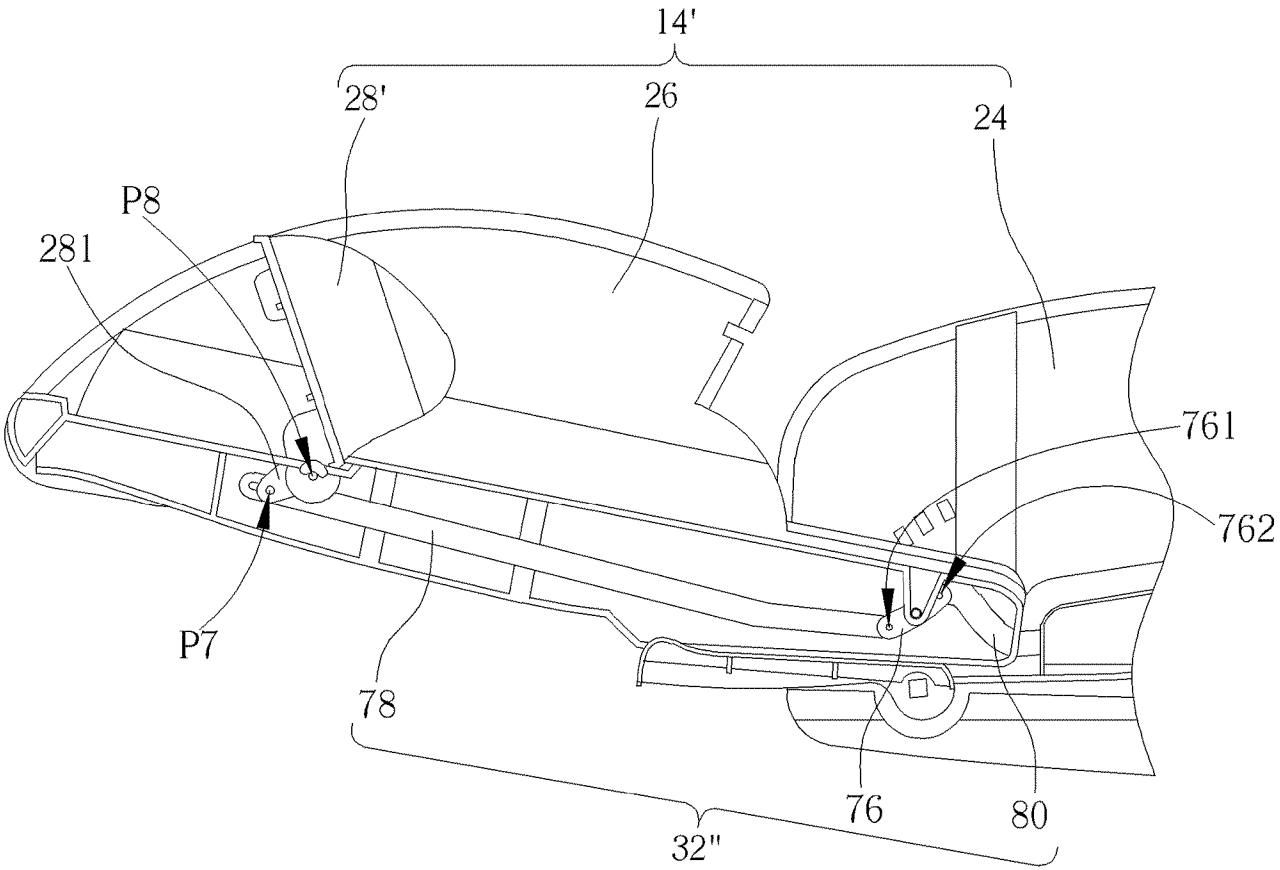
Figure 17:
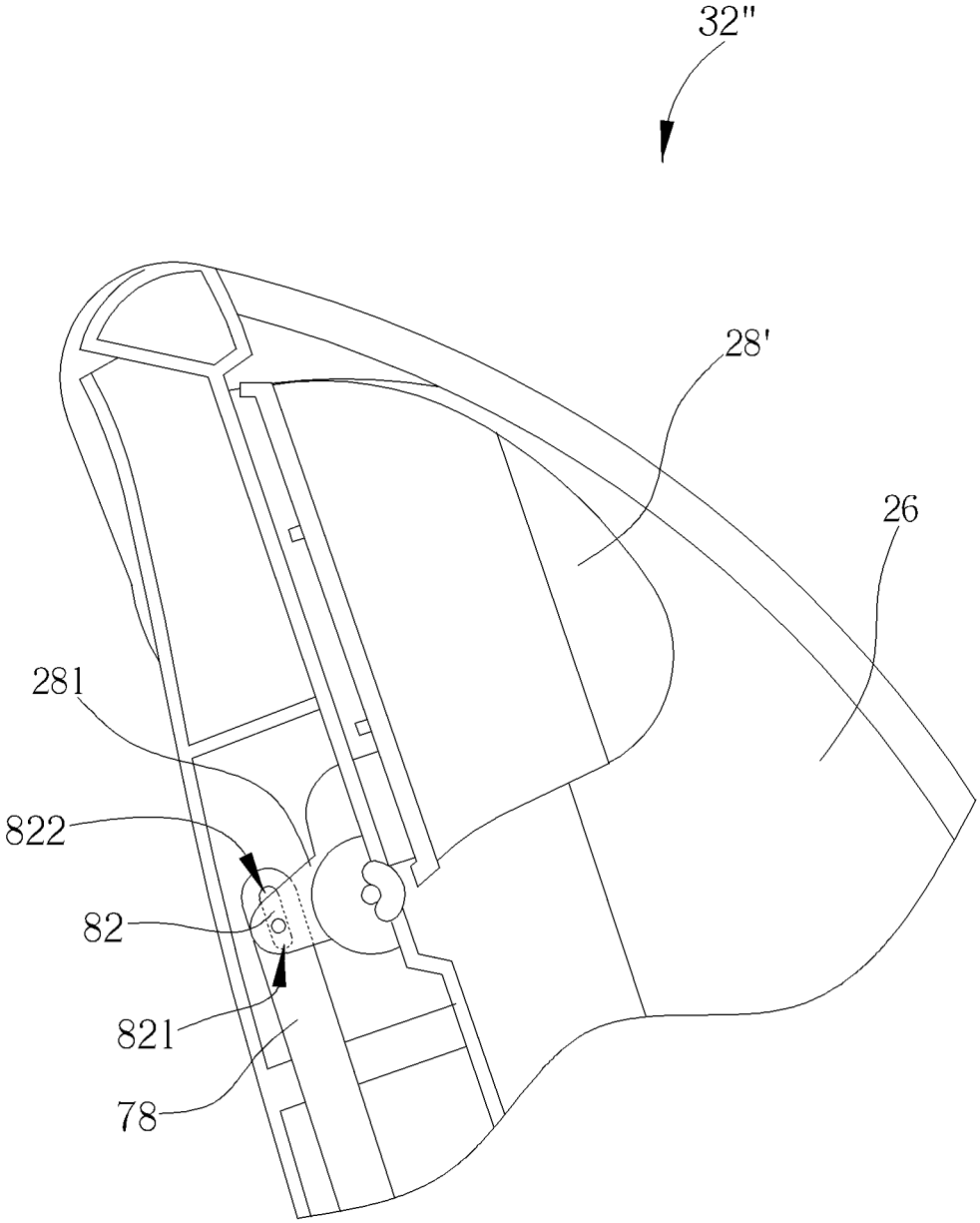
FIG. 17 is an enlarged partial diagram of the booster seat reclining mechanism according to the third embodiment of the present invention.

Please refer to FIG. 12, and FIG. 15 to FIG. 17. FIG. 15 and FIG. 16 respectively are diagrams of a booster seat reclining mechanism 32" (and the related booster seat 14') indifferent operation steps according to a third embodiment of the present invention. FIG. 17 is an enlarged partial diagram of the booster seat reclining mechanism 32" according to the third embodiment of the present invention. The booster seat reclining mechanism 32" includes a backrest rocker 76, a headrest linking component 78 and a seat linking component 80. The backrest rocker 76 is pivotally connected inside the booster seat backrest 26. Two opposite ends of the headrest linking component 78 are respectively connected to a first rocker arm 761 of the backrest rocker 76 and the booster seat headrest 28', and a pivot P7 between the headrest linking component 78 and the booster seat headrest 28' is distant from a pivot P8 between the booster seat headrest 28' and the booster seat backrest 26; further, two opposite ends of the seat linking component 80 are respectively connected to a second rocker arm 762 of the backrest rocker 76 and the booster seat bottom 24.

In the third embodiment, the seat linking component 80 is rigidly connected to the booster seat bottom 24, the backrest rocker 76 can be rotated in the clockwise direction while the booster seat backrest 26 is reclined, and rotation of the backrest rocker 76 drives the headrest linking component 78 to shift toward the booster seat headrest 28'. The booster seat headrest 28' is motionless as a part 281 of the booster seat headrest 28' is slidably located inside a link slot structure 82 disposed on the headrest linking component 78, and can be inward rotated by pushing of the headrest linking component 78 until the part 281 reaches to a rear end 821 of the link slot structure 82 for the delay deployment. While the booster seat backrest 26 is upright from a position shown in FIG. 16 to a position shown in FIG. 15, the headrest linking component 78 is shifted by the counterclockwise rotation of the backrest rocker 76, and the booster seat headrest 28' is motionless as the headrest linking component 78 is slid relative to the part 281 through the link slot structure 82. The booster seat headrest 28' can be outward rotated by pulling of the headrest linking component 78 till the part 281 reaches a front end 822 of the link slot structure 82.

In the present invention, the child high chair without the booster seat can be used in the kid mode, and the child high chair with the booster seat can be used in the toddler mode or the infant mode (which depends on a reclined angle of the booster seat backrest relative to the booster seat bottom). As the booster seat backrest of the booster seat is reclined, the youth seat reclining mechanism is applied to upward rotate the youth seat footrest and the booster seat reclining mechanism is applied to inward rotate the booster seat headrest, and the upward rotation of the youth seat footrest and the inward rotation of the booster seat headrest may be optionally delayed in accordance with the reclined angle's variation of the booster seat backrest, so that the child high chair of the present invention can comfortably fit children of various age ranges.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child high chair, comprising:

a high chair frame;

a youth seat disposed on the high chair frame, the youth seat comprising:

a youth seat bottom;

a youth seat footrest rotatably disposed on the youth seat bottom;

a youth seat backrest rotatably disposed on the youth seat bottom and opposite to the youth seat footrest; and a youth seat reclining mechanism located inside the youth seat bottom and connected between the youth seat footrest and the youth seat backrest; and a booster seat movably disposed on the youth seat bottom, the youth seat footrest being rotated relative to the youth seat bottom via the youth seat reclining mechanism while the youth seat backrest is simultaneously rotated by reclining of the booster seat;

wherein the booster seat backrest comprises a rib contacting against the youth seat backrest, and the youth seat backrest is rotated by pressure of the rib while the booster seat backrest is rotated relative to the booster seat bottom.

2. The child high chair of claim 1, wherein the booster seat comprises:

a booster seat bottom;

a booster seat backrest rotatably disposed on the booster seat bottom;

a booster seat headrest rotatably disposed on the booster seat backrest and opposite to the booster seat bottom; and a booster seat reclining mechanism located inside the booster seat backrest and connected between the booster seat bottom and the booster seat headrest, the booster seat reclining mechanism being actuated to rotate the booster seat headrest relative to the booster seat backrest while the booster seat backrest is rotated relative to the booster seat bottom.

3. The child high chair of claim 1, wherein the youth seat reclining mechanism comprises a backrest linking component, a bottom rocker and a footrest linking component, the backrest linking component is rigidly connected to the youth seat backrest, the footrest linking component is rotatably connected to the youth seat footrest, the bottom rocker is pivotally connected inside the youth seat bottom, and two arms of the bottom rocker are respectively connected to the backrest linking component and the footrest linking component.

4. The child high chair of claim 3, wherein the backrest linking component is rigidly connected to the youth seat backrest via a square tube, and synchronously rotated in accordance with rotation of the youth seat backrest relative to the youth seat bottom.

5. The child high chair of claim 3, wherein the two opposite arms of the bottom rocker comprises a first rocker arm and a second rocker arm, the first rocker arm is slidably located inside a backrest slot structure formed on the backrest linking component, and the footrest linking component is slidably located inside a rocker slot structure formed on the second rocker arm.

6. The child high chair of claim 5, wherein the youth seat footrest is rotated by pulling of the footrest linking component while the first rocker arm contacts against an end of the backrest slot structure and the footrest linking component contacts against an end of the rocker slot structure.

7. The child high chair of claim 1, wherein the booster seat headrest is rotated inwardly relative to the booster seat backrest and the youth seat footrest is rotated upwardly relative to the youth seat bottom in accordance with reclining of the booster seat upon the youth seat.

8. The child high chair of claim 1, wherein the booster seat reclining mechanism comprises a curved linking component passing through the booster seat backrest, a first link end of the curved linking component is pivotally connected to the booster seat headrest, and a second link end of the curved linking component opposite to the first link end is pivotally connected to the booster seat bottom.

9. The child high chair of claim 8, wherein a pivot between the first link end and the booster seat headrest is distant from a pivot between the booster seat headrest and the booster seat backrest, and a pivot between the second link end and the booster seat bottom is distant from a pivot between the booster seat backrest and the booster seat bottom.

10. The child high chair of claim 8, wherein the booster seat reclining mechanism further comprises a headrest slot structure disposed on the booster seat headrest, and the first link end of the curved linking component is slidably located inside the headrest slot structure.

11. The child high chair of claim 10, wherein the booster seat headrest is not rotated relative to the booster seat backrest while the first link end is slid inside the headrest slot structure, and the curved linking component is actuated to rotate the booster seat headrest relative to the booster seat backrest while the first link end contacts against an end of the headrest slot structure.

12. The child high chair of claim 1, wherein the booster seat reclining mechanism comprises a backrest rocker, a headrest linking component, a bottom linking component, a backrest cam and a seat follower, the backrest rocker is pivotally connected inside the booster seat bottom, two opposite ends of the headrest linking component are respectively connected to a first rocker arm of the backrest rocker and the booster seat headrest, two opposite ends of the bottom linking component are respectively connected to a second rocker arm of the backrest rocker and the seat follower, the backrest cam is fixed to the booster seat backrest, the seat follower is movably disposed on the booster seat bottom and slidably contacts against the backrest cam.

13. The child high chair of claim 12, wherein the backrest cam moves the seat follower into a retracted position while the booster seat backrest is reclined, and the seat follower pulls rotation of the backrest rocker via the bottom linking component to rotate the booster seat headrest.

14. The child high chair of claim 12, wherein the booster seat reclining mechanism further comprises a resilient component disposed between the seat follower and the booster seat bottom, the backrest cam is separated from the seat follower and the seat follower is recovered to an extended position via the resilient component while the booster seat backrest is upright, and the backrest rocker is rotated by movements of the seat follower and the bottom linking component, to recline the booster seat headrest via the headrest linking component.

15. The child high chair of claim 12, wherein a pivot between the headrest linking component and the booster seat headrest is distant from a pivot between the booster seat headrest and the booster seat backrest.

16. The child high chair of claim 1, wherein the booster seat reclining mechanism comprises a backrest rocker, a headrest linking component and a seat linking component, the backrest rocker is pivotally connected inside the booster seat backrest, two opposite ends of the headrest linking component are respectively connected to a first rocker arm of the backrest rocker and the booster seat headrest, and two opposite ends of the seat linking component are respectively connected to a second rocker arm of the backrest rocker and the booster seat bottom.

17. The child high chair of claim 16, wherein while the booster seat backrest is reclined or upright, the backrest rocker is rotated to drive the headrest linking component to push or pull the booster seat headrest accordingly, so as to rotate the booster seat headrest accordingly.

18. The child high chair of claim 16, wherein a link slot structure is disposed on the headrest linking component, and a part of the booster seat headrest is slidably located inside the link slot structure.

19. The child high chair of claim 16, wherein a pivot between the headrest linking component and the booster seat headrest is distant from a pivot between the booster seat headrest and the booster seat backrest.

* * * * *